US006524388B1

(12) United States Patent
Yamada et al.

(10) Patent No.: US 6,524,388 B1
(45) Date of Patent: Feb. 25, 2003

(54) COATING APPARATUS WITH A ROTATABLE BACKING ROLLING AND METHOD THEREOF

(75) Inventors: Kenji Yamada, Mihara (JP); Masahiro Sugihara, Mihara (JP); Hiroshi Miura, Mihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/708,669

(22) Filed: Nov. 9, 2000

(30) Foreign Application Priority Data

Apr. 3, 2000 (JP) ..... 2000-100924

(51) Int. Cl.[7] ..... B05C 5/00

(52) U.S. Cl. ..... 118/663; 118/712; 118/713; 118/50; 118/67; 118/324; 118/325; 118/326; 118/410; 118/DIG. 4

(58) Field of Search ..... 427/420; 118/DIG. 4, 118/663, 712, 713, 50, 67, 324, 325, 326, 410

(56) References Cited

U.S. PATENT DOCUMENTS 4,545,321 A * 10/1985 Bassa ..... 118/50

4,842,900 A * 6/1989 Miyamoto ..... 427/348

FOREIGN PATENT DOCUMENTS

JP 06-246215 * 9/1994
JP 07-008888 * 1/1995

* cited by examiner

*Primary Examiner*—Katherine A. Bareford
(74) *Attorney, Agent, or Firm*—Armstrong, Westerman & Hattori, LLP

(57) ABSTRACT

A coating apparatus and a coating method are provided capable of adjusting the coating conditions into optimum and producing stabilized coating film continuously. The coating apparatus comprises a backing roll 2; a coating color delivery slit 4; a gas chamber 10, disposed upstream to the coating color delivery slit 4, containing therein a gas injection nozzle 9 and a pressure sensor 7; a gas recovery chamber 14 disposed upstream to the gas chamber; a nozzle group 20 disposed upstream to the gas recovery chamber 14; and a pressure control device for controlling the pressure inside of the gas chamber within a predetermined pressure range based on the detection results of the pressure sensor.

5 Claims, 4 Drawing Sheets

COATING APPARATUS WITH A ROTATABLE BACKING ROLLING AND METHOD THEREOF

BACKGROUND OF THE INVENTION

1. Field of the Invention

The present invention relates to a coating apparatus and a coating method, applicable to paper coaters of paper manufacturing machines or to a coating process in steel plate manufacturing machines, for coating various coating materials (hereinafter called "web ") such as paper web and sheet, steel, and plastic film by applying a coating colors.

2. Background Art

The three following types of conventional coating apparatuses are known for improving the coating performance: (A) a coating apparatus provided with an air nozzle, (B) a coating apparatus provided with a gas chamber, and (C) a coating apparatus provided with an air nozzle and a gas chamber.

(A) A Coating Apparatus Provided With an Air Nozzle

FIG. 3 shows a structure of a coating apparatus provided with an air nozzle, disclosed in Japanese Utility Model Registration No. 2532902 by the same inventors as the present application. FIG. 3A is a side view, and FIG. 3B is a cross-sectional view showing the detail of the coating nozzle shown in FIG. 3A.

This conventional apparatus comprises a rotatable backing roll 1 for supporting and carrying the web, a slit-type nozzle 5 for applying aa coating color film 3, disposed above the web 1 in an non-contact state, and an air nozzle 40 disposed upstream adjacent to the slit nozzle 5.

This apparatus is constituted such that an air layer accompanied by the running web 1 can be removed by injecting air from the nozzle 40, and the injection amount and the injection speed of the air can be controlled by measuring the film thickness meter 45 and by an order form of the control unit 46 based on the measured results. Here, the numeral 4 denotes a coating color delivery slit nozzle, numeral 5 denotes a coating color nozzle body, 40 denotes an air injection nozzle, and 41 denotes an air chamber.

(B) A Coating Apparatus Provided With a Gas Chamber

FIG. 4 shows a structure of a coating apparatus provided with an air chamber, which is disclosed in Japanese Unexamined Patent Application, First Publication No. Hei 6-218313 by the same inventors as the present application. This apparatus also comprises the rotatable backing roll for supporting and carrying the web, a slit nozzle disposed in the non-contact state above the web 1 for applying coating color.

In this conventional apparatus, a gas chamber 52 is provided at an upstream position adjacent to the slit nozzle 5, and, prior to application of the coating color onto with the web surface, an air layer accompanied by the web 1 is replaced by a cohesive vapor layer which is soluble in the coating color and which coheres on the web surface.

The replacement of air accompanied by the web with the vapor layer allows not only the reduction of the contact pressure between the web surface and the coating color but also changes the contact angle of the coating color to the web surface into a bigger obtuse angle, which prevents involvement of air under the coating color film. Here, a jet nozzle 50 for the soluble liquid vapor 51 is provided in the gas chamber 52. The numeral 53 denotes a recovery pipe for recovering excessive vapor.

(C) An Apparatus Provided With Both of the Air Nozzle and the Gas Chamber

FIG. 5 shows a structure of a conventional coating apparatus, provided with both of the air nozzle and the gas chamber, which is disclosed in Japanese Patent (Granted) Publication No. 2917116.

As shown in FIG. 5, this conventional apparatus is provided with a gas chamber 32 and an air nozzle 30 at an upstream position adjacent to the coating color delivery nozzle 5. Carbon dioxide gas or a solvent gas is injected through a gas nozzle 31 into the gas chamber 32. High pressure air is injected through the air nozzle 30. In addition, a recovery box 33 is provided for recovering excessive high pressure air. Excessive air inside of the recovery box 35 is removed by a blower 27.

The above constitution allows removal of the air layer on the web 1 accompanied by the transfer of the web 1 by injecting high pressure air, and the gas is injected into the gas chamber 32 to change the inside of the gas chamber 32 into a negative pressure by the coanda effect due to the air ejection of air nozzle, and the air inside the gas chamber is replaced with the gas before coating the web surface for the purpose of improving the quality of the coated layer on the web.

The structure of the coating apparatus shown in FIG. 5 makes it possible to remove the surface air layer accompanied by the transfer of the web and covering the surface of the web with the gas layer inside of the gas chamber, so that it is unlikely that air is involved between the web surface and the coating color.

However, removal of the air involvement can be kept in good conditions provided that the web transfer speed and the coating speeds are maintained constant. That is, the removal of the air involvement is attained only when coating conditions, such as the web transfer speed, the pressure condition of the gas chamber, and the coating speed of the coating color, are suitably adjusted.

For example, when the coating is done under the higher air amount from the air nozzle suitable for the transfer speed, the negative pressure in the gas chamber increases, so that the web 1 is likely to rise from the backing roll, so that the dragging force between the web and the backing roll becomes insufficient. In addition, since the gas injected from the gas chamber does not reach to the web surface or since the retention time of the gas layer on the web surface is not sufficient because of the low negative pressure of the gas chamber, the replacement of the air layer with the gas layer becomes insufficient.

In contrast, when the coating is done under the lower air volume suitable for the transfer speed, the involvement of the air may occur or the excessive air in the color layer may remain by the insufficient replacement of the air layer with the gas layer.

When such a discrepancy from the optimum conditions occurs, air enters between the coating color film and the web surface, and the thus entrained air remains as tiny bubbles, which cause the degradation of the coat layer.

The above described Japanese Patent (Granted) Publication No. 2917116 also discloses a structure, as shown in FIG. 6, which provides a suction tube having an opening close to the web surface. This structure, however, is liable to generate a local area, in which the pressure is a higher negative pressure, so that the web 1 is liable to rise away from the backing roll. That is, this structure has a problem that such a local area at a higher negative pressure may be caused.

SUMMARY OF THE INVENTION

It is therefore an object of the invention to provide an coating apparatus capable of maintaining coated products with a constant good coating quality even when the process conditions vary by automatically maintaining the negative pressure in the gas chamber within a predetermined range. That is, the present coating apparatus and the coating method are obtained by recognizing the fact that a control of the negative pressure in the gas chamber within a predetermined range is an important factor for coated products with a good coating quality.

Accordingly, it is an object of the present invention to provide a coating apparatus and a coating method capable of stable formation of the coating film under the optimum conditions even when the process condition such that the base material transfer speed or the process conditions fluctuate.

The first aspect of the present invention provides a coating apparatus comprising: a rotatable backing roll, the outer periphery of which forms the base material carrying path; a die for delivering in the form of a coating color curtain onto the base material; a gas chamber disposed above the base material upstream to said coating color delivery die and comprises therein a gas injection mechanism and a pressure detecting sensor; and an air injection device disposed upstream to said gas chamber; a pressure control device for controlling the ambient pressure in said gas chamber within a predetermined range by controlling a gas injecting condition by said gas injection device and an air injecting condition by said air injection device based on the results of the detection by said pressure detecting sensor disposed in said gas chamber.

In the coating apparatus according to the second aspect, a gas recovery chamber is provided between said gas chamber and said air injection device, and a gas recovery condition of the gas recovery chamber is controlled by said pressure control device.

In the coating apparatus according to the third aspect, a gas recovery chamber is provided upstream to the air injection device and a gas recovery condition of the gas recovery chamber is controlled by the pressure control device.

In the coating apparatus according to the fourth aspect, an evacuation device is connected to said gas recovery chamber and a plurality of through holes for enabling a gas recovery from the gas chamber toward the gas recovery chamber by said evacuation device are formed in a partition wall for isolating the gas chamber from the gas recovery chamber and positioned with some distance from the base material.

In the coating apparatus according to the fifth aspect, said air injection device is comprised of a plurality of air injection nozzles, in which air injection speed and the air injection amount are controllable individually.

In the coating apparatus according to the sixth aspect, a type of gas injected by said gas injection mechanism is preferably a cohesive gas soluble in the coating color.

In the coating apparatus according to the seventh embodiment, a partition wall is provided between said gas chamber and said coating color delivery slit.

In the coating apparatus according to the eighth embodiment, the coating apparatus comprises an observation device for observing the contact state between the coating color curtain and the base material, and wherein said pressure control device conducts a control operation based on the observation result by the observation device in addition to the detection results of said pressure detection sensor.

A coating method according to the ninth aspect for coating a coating color on a base material carried by a backing roll, the coating method comprises the steps of: providing a gas chamber upstream to the coating position of the coating color; and a controlling method for controlling the pressure inside the gas chamber within a predetermined range.

In a coating method according to the tenth aspect, the coating method comprises the steps of: providing a gas recovery chamber upstream to said gas chamber, and the gas recovery chamber being connected to an evacuation device, and a plurality of through holes being positioned with some distance from the base material in a partition plate partitioning the gas recovery chamber from the gas chamber; and conducting the gas recovery while controlling the pressure in the gas chamber by said evacuation device within a predetermined negative pressure range by evacuating the gas in said gas chamber.

In a coating method according to the eleventh aspect, the coating method comprises the steps of: providing an air injection device upstream to a gas chamber comprised of a plurality of air nozzles, in which, an air injection speed and an air injection amount can be controlled independently each other; and injecting air from those air nozzles while controlling the air injection speed and the air injection amount independently each other.

According to the first aspect, the base material is carried along the base material transfer path formed on the surface of the backing roll. Air is first injected by the air injection mechanism on the surface of the base material for removing the air layer accompanied by running the base material. Subsequently, as the base material passes through the gas chamber, the remaining air layer is replaced with the gas layer, and immediately, the coating color is delivered on the base material through the coating color delivery slit.

When the base material transfer speed is changed according to the change of the coating condition, the amount of air on the surface of the base material changes. The change of the amount of air can be detected by the pressure detection sensor in the gas chamber. Based on the thus detected pressure value, the pressure control device controls the pressure in the gas chamber within a predetermined negative pressure range by controlling the gas injection condition using the gas injection mechanism and the air injection condition by the air injection device. In this control operation; (1) although the air layer accompanied by running the base material changes when the transfer speed of the base material changes, but the air layer is effectively removed by changing the air injection conditions so as to, for example, change both air injection speed and air injection amount at the same time when the accompanied air amount increases, and (2) subsequently, the air layer is replaced with the gas layer and this replacement is efficiently carried out by changing the gas injection conditions using the gas injection mechanism so as to maintain the pressure in the gas chamber within a predetermined negative pressure range.

According to the second aspect and third aspect of the present invention, gas recovery is conducted by the gas recovery chamber and the pressure control inside of the gas chamber can be carried out effectively by the gas recovery.

According to the fourth aspect, the gas recovery is carried out through a plurality of through holes which are formed in the partition wall and which are formed separated from the base material. Therefore, influences of the local evacuation through those holes to the web surface can be avoided.

According to the fifth aspect, the present coating apparatus is provided with an air injection device comprising a plurality of air nozzles and the air injection speed and the air injection amount of each air injection nozzle can be controlled individually. The air layer accompanied by running base material can be removed efficiently by these air nozzles.

According to the sixth aspect, since the cohesive gas, which is soluble to the coating color, is injected by the gas injection mechanism on the surface of the base material, the air layer on the base material can be effectively replaced with the cohesive gas layer; thereby, the contact angle of the coating color curtain with the base material can be changed into a bigger obtuse angle, which effectively eliminates involvement of air under the coating color layer.

According to the seventh aspect, a partition wall is provided between the gas chamber and the coating color curtain discharged from the color delivery slit, and the gas from the gas injection mechanism can be effectively interrupted such that the gas does not disturb smooth down flow of the coating color from the coating color delivery slit.

According to the eighth aspect, since the coating operation is controlled observing the contact state of the coating color curtain with the base material, the coating conditions can be controlled in more a direct and a more practical manner.

According to the ninth aspect, since the internal pressure of the gas chamber is controlled within a predetermined pressure range, the surface conditions of the base material can be always maintained constant by eliminating the effects of the change of the coating conditions such as the change in the transfer speed of the base material.

According to the tenth aspect, since the evacuation of the gas from the gas chamber is carried out through the through holes positioned with some distance from the base material, the evacuation can be carried out effectively without generating a locally evacuated influences to the web surface.

According to the eleventh aspect, since the air injection device is comprised of a plurality of air nozzles, in which the air injection speed and the air injection amount can be controlled individually, the air layer on the base material can be effectively removed.

DETAILED DESCRIPTION OF THE INVENTION

Hereinafter, a coating apparatus and a coating method according to one first embodiment of the present invention are described with reference to FIGS. 1 and 2.

Figure 1:
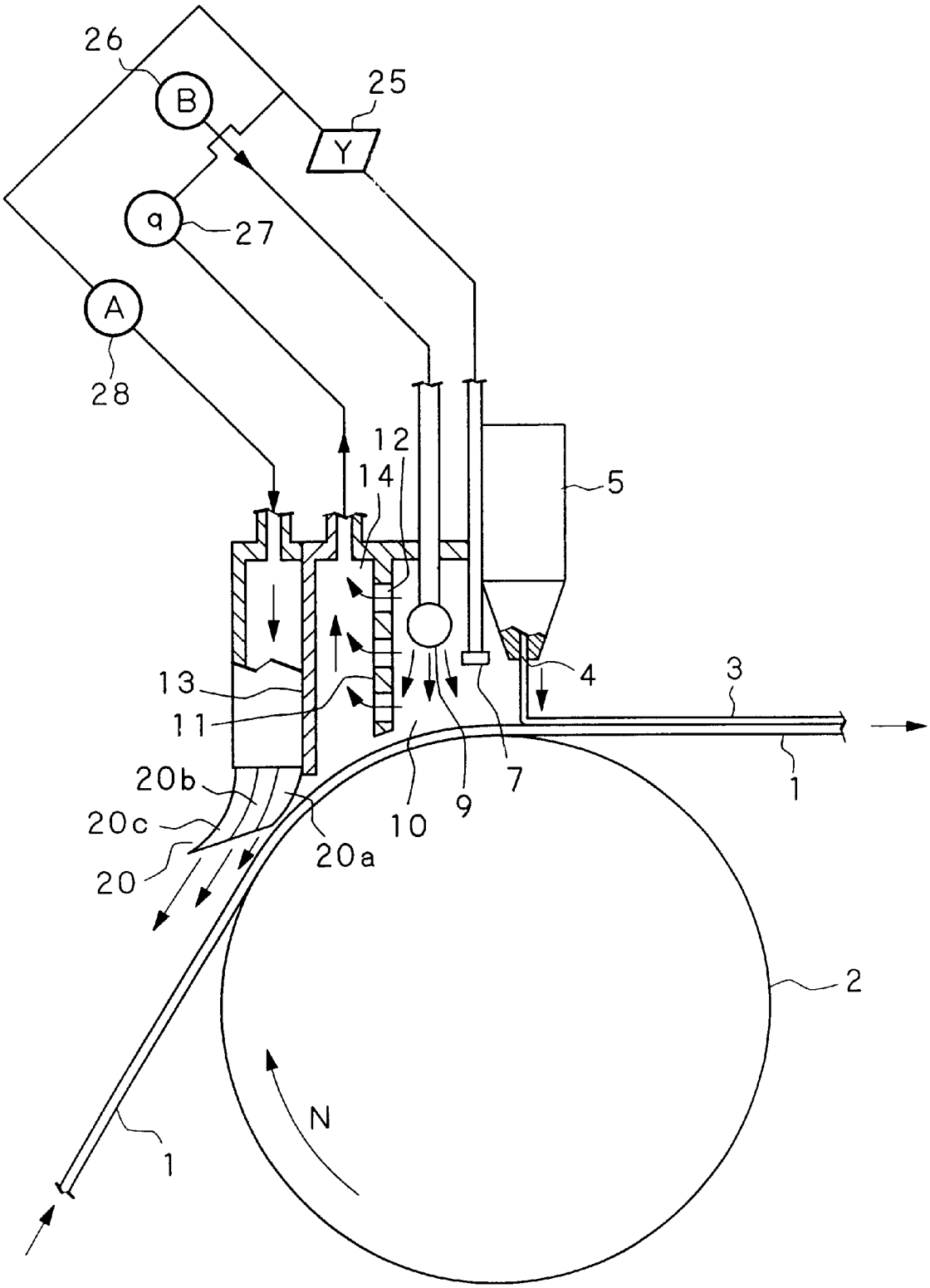
FIG. 1 is a side view showing a coating apparatus according to the present invention.

FIG. 1 is a side view showing a coating apparatus according to the present invention. The coating apparatus of the present invention comprises a horizontal transfer path of the web (the base material) 1 formed on the surface of a backing roll 2, disposed rotatably in the direction of the arrow N in FIG. 1, a die 5 provided with a coating slit 4 extended in the traversal direction to the web transfer direction. A coating film 3 is formed on the web 1 by discharging the coating color on the web 1 from the coating color delivery slit 4.

The said coating apparatus according to the present invention comprises a gas chamber 10 disposed vertically upstream to the coating die 5 and extended in the direction of the web transfer direction. In the gas chamber 10, there is provided a gas injection nozzle (a gas injection mechanism) 9 for injecting a suitable gas, such as a soluble gas or steam into the coating color, and a pressure detecting sensor 7. Gas (gas or stem) is supplied into the gas chamber 10 by a gas injection mechanism 9. It is noted that the type of gas injected by the gas injection nozzle 9 is not limited, but it is preferable that the gas can adhere to the base material and soluble into the coating color.

Furthermore, a plurality of holes (through holes) 12 for gas recovery are formed through the guide plate disposed upstream to the gas chamber 10. Here, the holes 12 are not located in proximity to the web surface, but positioned with some distance from the web surface. The number, arrangement, and shape of these holes 12 can be optionally selected providing the restriction of the hole arrangement is fulfilled.

A gas recovery chamber 14 is provided upstream to the gas chamber 10. The gas recovery chamber 14 is disposed vertically facing the horizontal web transfer path and extended in the traversal direction of the web transsfer direction. The gas recovery chamber 14 is defined by the vertical downstream guide plate 11, the vertical upstream guide plate 13, and side walls (not shown). A vacuum pump (an evacuation device) 27 is connected to the gas recovery chamber 14. The coating apparatus of the present invention is constituted such that operation of the vacuum pump 27 not only enables absorbing the gas in the gas recovery chamber but also enables absorbing the gas in the gas chamber 10 through the holes 12.

A group of air nozzles (air injection device) 20 are provided upstream to the gas recovery chamber 14 for removing the air accompanied by the running web 1. The air nozzle group 20 are disposed vertically with respect to the horizontal web transfer direction and extended in the traversal direction of the web transfer direction. The air nozzle group 20 includes a plurality of air nozzles. In the embodiment described in FIG. 1 three air nozzles 20*a*, 20*b*, and 20*c* constitute the air nozzle group.

The constitution of the air injecting device 20 by a plurality of air nozzles is a measure to effectively remove an air layer accompanied by the running web 1, and each air nozzle is constituted such that the air injection speed and the air injection amount can be controlled individually.

Although the present invention is not limited, preferable operating conditions of the air nozzles for effectively removing the air layer on the web surface are as follows: the injection speed of the nozzle 20*a*, which is the closest to the web, is made faster than the injection speeds of the other nozzles, and the air injection amounts of air nozzles 20*b* and 20*c* are made larger than that of the other nozzle 20*a*. The air injection angle is preferably 10 to 45 degrees with respect to the tangential line of the backing roll.

The air injection speed and the air injection amount for each air nozzle 20*a* to 20*c* are controlled individually by blowers 28 and the control valves (not shown), although only one control line is shown in FIG. 1.

A pressure control device 25 is provided in the present invention, capable of totally controlling the operating conditions of respective processes such as the gas injection condition by the gas injection nozzle 9, the gas recovery condition of the gas recovery chamber 14, and the air injection conditions by the air nozzle group 20 based on the pressure detection sensor 7.

Hereinafter, an example of a coating operation is described.

In general, the amount of air remaining on the web accompanied by the web increases with the increase of the coating speed (corresponding to the web transfer speed). When the web transfer speed changes for some reasons, the amount of air on the web changes. Thus, when the web transfer speed increases, it is necessary to increase the injection speed of air from the air nozzle 20 and the amount of air injected by said air nozzle.

In the present invention, the pressure in the gas chamber 10 is detected by the pressure detection sensor 7, and a judgement is made based on the detected results by the pressure control device 25. The pressure control device 25 controls conditions such as the gas injection condition using the gas injection nozzle 9, the gas recovery conditions using the gas recovery chamber 14, and the air injection conditions using the air nozzle group 20, in order to maintain the pressure (a negative pressure) in the gas chamber at a predetermined value (practically, within a predetermined range).

Figure 2:
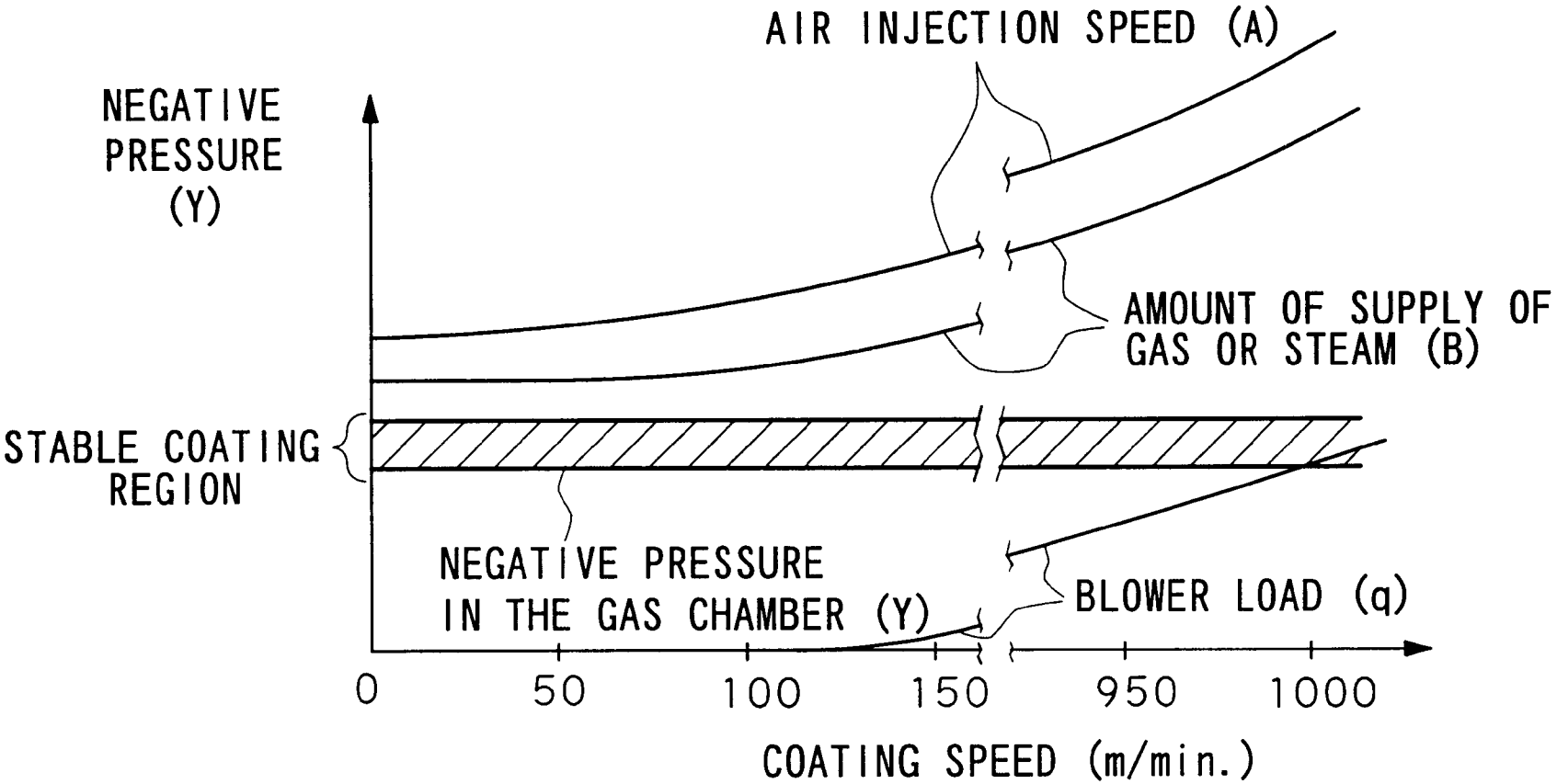
FIG. 2 is a graph showing an example of methods for controlling the ambient pressure of the gas chamber in the coating process of the present invention.
Figure 3A:
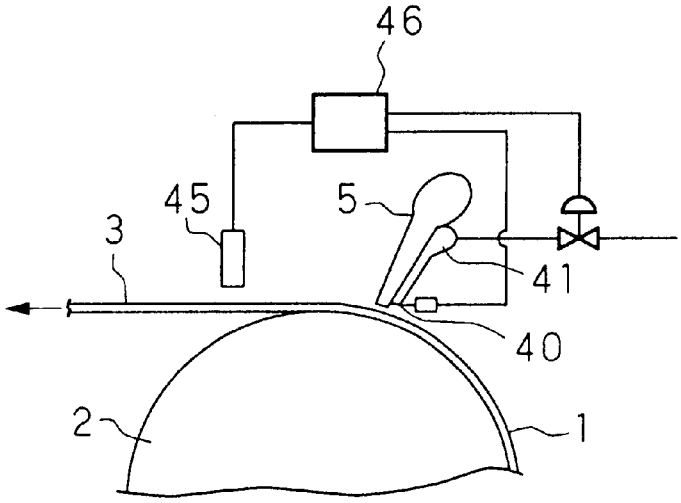
FIG.3A PRIOR ART
FIGS. 3A and 3B are side views showing a structure of a conventional coating apparatus provided with an air nozzle.
Figure 3B:
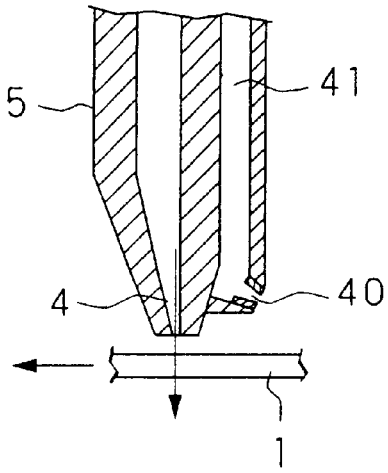
FIG.3B PRIOR ART
Figure 4:
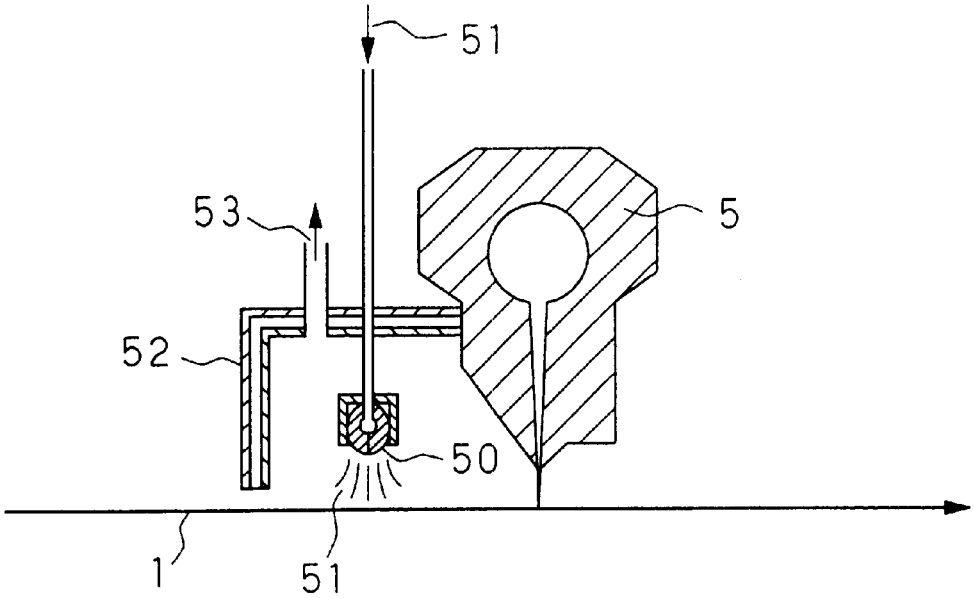
FIG.4 PRIOR ART
FIG. 4 is a side view showing a structure of a conventional coating apparatus provided with a gas chamber.
Figure 5:
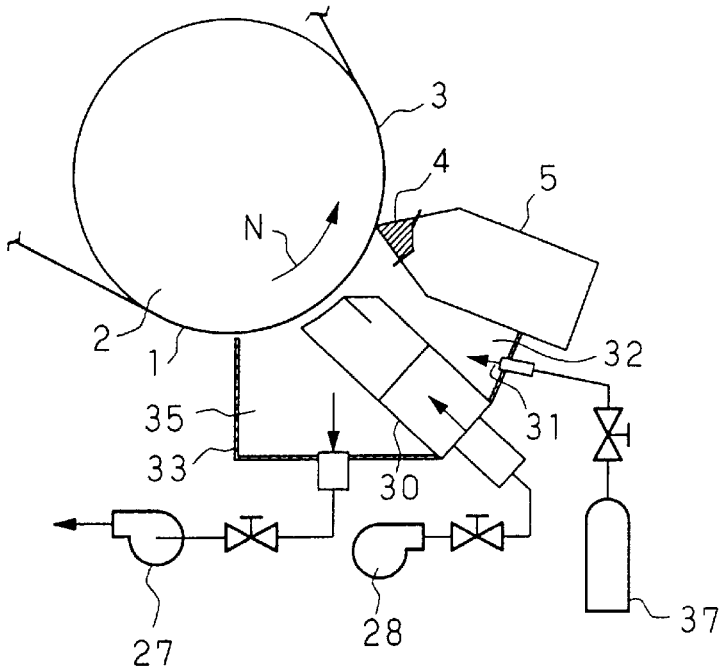
FIG.5 PRIOR ART
FIG. 5 is a side view showing a structure of a conventional coating apparatus provided with both the air nozzle and the gas chamber.
Figure 6:
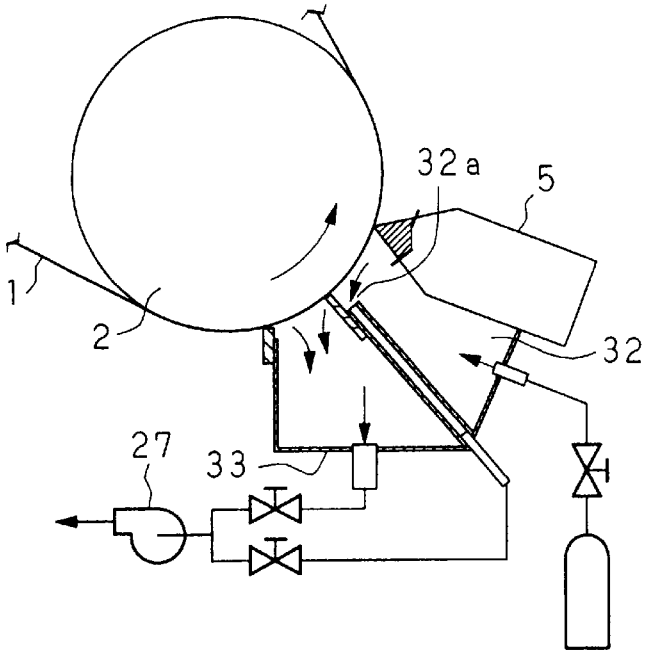
FIG.6 PRIOR ART
FIG. 6 is a side view showing the other structure of a conventional coating apparatus provided with both the air nozzle and the gas chamber.

That is, as shown in FIG. 2, the air injection speed (A) by the air nozzle group, the supply amount of the gas (B) from the gas injection nozzle 9, and the load (q) of the vacuum pump are controlled so as to maintain the negative pressure in the gas chamber within a predetermined range Y (within an hatching area), irrespective of the change of the coating speed. The use of this control system makes it possible to maintain the negative pressure around the coating color delivery slit 4 at a constant negative pressure, irrespective of the coating speed. Thus, the constantly stable coating products can be kept by the use of the present coating apparatus.

Although FIG. 2 shows the limited speed range, the control system and device are the same even in more high speed range (for example, 1500 m/min.)

Since the optimum pressure Y changes with the properties of the coating color, the optimum pressure should be selected according to the properties of the coating color (viscosity, adhesiveness, etc.).

Although the gas recovery chamber 14 is disposed between the gas chamber 10 and the air nozzle group (the air injecting device) 20, the present invention is not limited to this structure. That is, that the present invention includes a structure without providing the gas recovery chamber or that the present invention includes a structure having a gas recovery chamber upstream to the air injection device.

Although the present embodiment includes a plurality of holes (through holes) formed in the upstream guide plate (partition plate) 11, the present invention includes a structure without having such holes.

Furthermore, although not shown in the present embodiment, it is preferable to provide a partition wall between the gas chamber 10 and the coating color delivery slit 4. This partition wall prevents a coating color curtain delivery from the delivery slit 4 from being disturbed by the gas injected from the gas injection nozzle 9. Various types of partition walls may be used such as a wall having many through holes or a mesh-type air permeable wall.

Provision of an observation device is preferable for observing the contact state of the coating color curtain to the web 1. Suitable examples for the observation device include a laser displacement measuring device and a image processing device plus CCD cameras. When the coating apparatus is controlled additionally considering the result of the observation device, it becomes possible to detect the phenomenon that air is involved at the coating color curtain, that is, the contact point between the coating color curtain and the web 1 is moved downstream to the web 1 by the web dragging force. Thus, addition of the observation device assists conducting a more direct and a more practical control of the coating conditions.

The coating apparatus and the method for coating show the following effects. In the coating apparatus of the present invention, when the base material transfer speed is changed according to the change of the coating condition, the amount of air on the surface of the base material changes. The change of the amount of air can be detected by the pressure detection sensor in the gas chamber. Based on the thus detected pressure value, the pressure control device controls the pressure in the gas chamber within a predetermined negative pressure range by controlling the gas injection condition using the gas injection mechanism and the air injection condition by the air injection device. In this control operation; even when the amount of air accompanied by the running speed of the base material changes, the air layer is effectively removed by changing the air injection conditions so as to, for example, change both air injection speed and air injection amount, and subsequently, the air layer is replaced with the gas layer while controlling the gas injection conditions using the gas injection mechanism so that the pressure of the gas chamber is maintained within a predetermined negative pressure range. Therefore, the constant coating conditions are maintained and good coating quality are always secured during the coating operation.

In addition, gas recovery is conducted by the gas recovery chamber and the pressure control inside of the gas chamber can be carried out effectively by the gas recovery. The gas recovery is carried out through a plurality of through holes which are formed in the partition wall and which are formed separated by a space from the base material. Therefore, influences of the local evacuation through those holes to the web surface can be avoided.

The concept of the present invention for coating apparatus and coating method also includes the application thereof in connection with a different type die where the coating is applied in different positions around the backing roll, and also there are many variations regarding with the web paths around the backing roll within the spirit and scope of the inventive concept of the present invention.

What is claimed is:

1. A coating apparatus comprising:

a rotatable backing roll having a surface which forms a base material transfer path, a coating color delivery slit for delivering a coating color film on the base material;

a gas chamber disposed above the base material upstream to said coating color delivery slit and comprising therein a gas injection mechanism and a pressure detecting sensor;

an air injection device disposed upstream to said gas chamber;

a pressure control device for controlling pressure in said gas chamber within a predetermined range by controlling a gas injecting condition by said gas injection device and an air injecting condition by said air injection device based on results of the detection by said pressure detecting sensor disposed in said gas chamber;

wherein a gas recovery chamber is provided between said gas chamber and said air injection device, and wherein a gas recovery condition of the gas recovery chamber is controlled by said pressure control device; and wherein an evacuation device is connected to said gas recovery chamber and a plurality of through holes for enabling a gas recovery from the gas chamber toward the gas recovery chamber by said evacuation device are formed in a partition wall for defining said gas chamber from the gas recovery chamber and positioned a distance away from the base material.

2. The coating apparatus according to claim 1, wherein said air injection device comprises a plurality of air injection nozzles, in which air injection speed and air injection amount are each individually controllable.

3. The coating apparatus according to claim 1, wherein a type of gas injected by said gas injection mechanism is a cohesive gas soluble to the coating color.

4. The coating apparatus according to claim 1, wherein a partition wall is provided between said gas chamber and said coating color delivery slit.

5. The coating apparatus according to claim 1, wherein the coating apparatus comprises an observation device for observing a contact state of the coating color film to the base material, and wherein said pressure control device conducts a control operation based on a result from the observation device in addition to detection results from said pressure detection sensor.

* * * * *